US009151577B2

(12) United States Patent
Smith

(10) Patent No.: US 9,151,577 B2
(45) Date of Patent: Oct. 6, 2015

(54) PYRAMID-SPHERE BUNKER SYSTEM

(71) Applicant: Rixford Smith, Fort McMurray (CA)

(72) Inventor: Rixford Smith, Fort McMurray (CA)

( * ) Notice: Subject to any disclaimer, the term of this patent is extended or adjusted under 35 U.S.C. 154(b) by 0 days.

(21) Appl. No.: 14/323,310

(22) Filed: Jul. 3, 2014

(65) Prior Publication Data

US 2015/0007758 A1 Jan. 8, 2015

Related U.S. Application Data

(60) Provisional application No. 61/842,485, filed on Jul. 3, 2013.

(51) Int. Cl.

| | |
|---|---|
| ***E04H 9/00*** | (2006.01) |
| ***F41H 5/24*** | (2006.01) |
| ***F41H 5/04*** | (2006.01) |
| ***E04H 9/10*** | (2006.01) |

(52) U.S. Cl.

CPC .. *F41H 5/24* (2013.01); *E04H 9/10* (2013.01); *F41H 5/04* (2013.01); *Y10T 29/49826* (2015.01)

(58) Field of Classification Search

CPC ..... E04H 9/00; E04H 9/10; E04H 9/14; E04H 1/12; F41H 5/24; F41H 5/02

USPC ..... 52/85–86, 88–89, 79.1, 79.4, 169.6, 52/742.1, 745.07, 80.1, 81.1, 81.2; 109/1 S, 49.5; 405/125; 89/36.02, 89/36.07; 264/31

See application file for complete search history.

(56) References Cited

U.S. PATENT DOCUMENTS

| | | | | | |
|---|---|---|---|---|---|
| 1,171,316 | A | * | 2/1916 | Camblin | 249/209 |
| 1,424,342 | A | * | 8/1922 | Compton | 249/209 |
| 1,964,386 | A | * | 6/1934 | Nose et al. | 249/11 |
| 3,643,910 | A | * | 2/1972 | Heifetz | 249/65 |
| 3,734,670 | A | * | 5/1973 | Stickler, Jr. | 425/405.1 |
| 3,940,105 | A | * | 2/1976 | Metrailer | 249/209 |
| 4,094,110 | A | * | 6/1978 | Dickens et al. | 52/81.1 |
| 4,185,805 | A | * | 1/1980 | Ewing | 249/210 |
| 4,210,304 | A | * | 7/1980 | Mannina | 249/22 |
| 4,695,187 | A | * | 9/1987 | Mikhailovsky et al. | 405/124 |
| 5,655,338 | A | * | 8/1997 | Lucas | 52/169.6 |
| 5,833,394 | A | * | 11/1998 | McCavour | 405/126 |
| 6,067,889 | A | | 5/2000 | Brown | |
| 6,076,313 | A | * | 6/2000 | Pannell et al. | 52/169.6 |
| 6,151,841 | A | * | 11/2000 | Green | 52/79.4 |
| 6,205,717 | B1 | * | 3/2001 | Shall et al. | 52/89 |

(Continued)

FOREIGN PATENT DOCUMENTS

| | | |
|---|---|---|
| CA | 2000436 | 4/1990 |
| CA | 2438802 | 1/2007 |

*Primary Examiner* — Beth Stephan

(74) *Attorney, Agent, or Firm* — Goodwin Law; Susan L. Rancourt

(57) ABSTRACT

A bunker comprising an exterior pyramid or cone structure made from an energy-absorbing material and an interior hollow spherical structure. The bunker may further comprise a sloped enclosing structure disposed around the exterior pyramid or cone structure. The energy absorbing material may be a solid, liquid or gel, and may be a compressible material. The combination of an outer pyramid or cone structure and an inner spherical structure is very stable. Persons or materials are housed in the inner hollow structure, and are protected from the impact of projectiles such as bombs or shells, or from other dynamic loads, by this combination of two strong geometric shapes with an energy-absorbing material in between.

20 Claims, 3 Drawing Sheets

(56) References Cited

U.S. PATENT DOCUMENTS

| | | | | |
|---|---|---|---|---|
| 6,481,166 | B2 * | 11/2002 | Shelton | 52/167.1 |
| 6,808,156 | B2 * | 10/2004 | Bond | 249/209 |
| 6,840,013 | B2 * | 1/2005 | South | 52/2.15 |
| 7,882,660 | B2 * | 2/2011 | Kitagawa | 52/81.1 |
| 2004/0075041 | A1 * | 4/2004 | Bond | 249/209 |
| 2006/0174549 | A1 * | 8/2006 | Dagher et al. | 52/86 |
| 2006/0201091 | A1 * | 9/2006 | Lockwood et al. | 52/380 |
| 2013/0202359 | A1 * | 8/2013 | Aston et al. | 405/126 |

* cited by examiner

PYRAMID-SPHERE BUNKER SYSTEM

CROSS REFERENCE TO RELATED APPLICATION

This application claims the benefit of U.S. Provisional Patent Application No. 61/842,485 filed on Jul. 3, 2013, the entire disclosure of which is incorporated herein by reference.

FIELD

Described herein is a bunker construction that is made of a hollow sphere structure inside a hollow pyramid or cone structure, between which are disposed an energy-absorbing material. The hollow sphere structure comprises a cavity in which materials, persons or buildings can be housed.

BACKGROUND

In some environments it is important to have a protective and resistant structure to enclose materials (i.e., munitions; chemicals; nuclear waste storage), persons or buildings (control centres; hospitals), the structure able to mitigate or withstand the impact of projectiles such as bombs or shells, or that can otherwise withstand very high dynamic loads, such as cyclic, impactive or impulsive loads.

Such protective structures, known as bunkers, can be portable or fixed. They are often partially or completely buried underground under compacted layers of soil, especially in military settings. In a military setting, portable protective bunkers which are easy to set up at a selected site to enhance the safety of military personnel are very desirable.

As well, larger more permanent bunker structures that can protect ammunition or other explosive or dangerous materials, or that can house entire rooms or buildings to protect them from outside attack are also very desirable.

A portable combat bunker is described in U.S. Pat. No. 6,067,889. This bunker is stated to be portable and reusable, formed of molded hollow plastic modules temporarily joinable by wooden beams and metal brackets. The modules are assembled on site and filled with water or sand, which is drained when the bunker is moved to a new location.

U.S. Pat. No. 6,205,717 describes a bunker construction that is formed of precast concrete arch elements which form a semicircular roof of the bunker, and front and back plates on the ends of the bunker. This bunker is covered with protective earth, thereby allegedly forming a bunker construction with enhanced structural integrity due to the mechanically stabilized earth in combination with the precast arch elements and the front and back plates.

Canadian patent application no. 2,000,436 describes a device for improving the resistance of structures, in particular made of concrete, such as shelters, sheds, building, walls, paved surfaces, to the impact of conventional projectiles such as bombs and shells. The device comprises a surface formed by a succession of ribs and grooves with a substantially V-shaped profile and smooth, inclined lateral faces. These surfaces deflect a projectile after impact, to weaken the impact of the projectile on the structure.

Canadian patent no. 2,438,802 describes a structural system that absorbs impactive and impulsive loads and that comprises a main structure, a crushable filling layer around the main structure and an outer shield around the crushable filling layer. If an impactive load exceeds a certain level, the outer shield slides, crushing the filling layer and absorbing a substantial amount of energy.

What is needed is a better bunker system that can withstand forces that are applied to it to protect persons or property inside the bunker, and one that is easy to set up when being used as a portable bunker system.

SUMMARY

Generally, embodiments of a bunker are disclosed, the enclosing structure of which lessens the energy transfer from the majority of incoming dynamic loads including through load deflection, to minimize the load that must be absorbed, to best absorb or dissipate energy transferred to the structure and, of the transferred energy that is ultimately imparted to the bunker, to best protect the elements housed within. To do so, a composite structure is provided having exterior walls sloped to lessen the angle of attack, presenting a surface that minimizes surfaces that are perpendicular to most incoming lateral and vertical loads, the walls being sloped in both the vertical and azimuthal attack directions. Further, an inner spherical protective structure, or chorded portion thereof, is provided about an interior cavity, the spherical shape distributing loads imposed thereon.

Between the exterior (outer) sloped walls and the interior (inner) spherical structure is an intermediate layer of energy-absorbing material for absorbing the energy of an impact and for distributing point loads about the spherical interior. One form of energy-absorbing material is a compressible material, a material that compresses upon application of a load. The exterior walls can be formed of the energy-absorbing material or the bunker can further comprise a sloped enclosing structure disposed over the exterior walls. In embodiments, the energy-absorbing material can be formed within an enclosing structure that may or may not also have energy-absorbing characteristics itself.

In one aspect, disclosed herein is a bunker comprising:

a) an exterior sloped structure made from an energy-absorbing material, and b) a hollow spherical structure inside the exterior sloped structure.

In some embodiments, the exterior sloped structure is a pyramid, and in others, a cone. The bunker may further comprise a sloped enclosing structure disposed about the exterior sloped structure.

In some embodiments the sloped enclosing structure is comprised of steel. In some embodiments the spherical structure is comprised of steel. In some embodiments the energy-absorbing material is a compressible material. The compressible material may be, for example, concrete or ballistic foam. In other embodiments the energy-absorbing material is a liquid or gel.

In another aspect disclosed herein is a bunker that comprises:

a) an exterior hollow sloped enclosing structure, b) an interior hollow spherical structure inside the exterior hollow sloped enclosing structure, c) a space between the exterior hollow sloped enclosing structure and the interior hollow spherical structure, and d) an energy-absorbing material disposed in the space.

In various embodiments, the sloped enclosing structure is a hollow pyramid or cone structure such as a four sided pyramid, with a square base and an apex that passes through the centre of the base; a three sided pyramid, with a triangular base, and an apex that passes through the centre of the base; and a cone, with a circular base and an apex that passes through the centre of the base. These structures present exterior surfaces, forming exterior walls, which are sloped from the vertical. Further, the structure can be oriented such that the probability of a wall being perpendicular to the vector of an incoming attack is minimized. The cone embodiment only presents one possible perpendicular strike, any variation in the vector resulting in a non-zero angle of attack and improved deflection capability.

In various embodiments the interior hollow spherical structure is a sphere or part of a sphere, such as a dome, or an ovoid or part of an ovoid.

In one embodiment, the exterior hollow sloped enclosing structure is comprised of steel. In one embodiment the inner hollow spherical structure is comprised of steel.

In various embodiments, the energy-absorbing material may be a compressible material selected from the group consisting of: concrete, a ballistic foam or sand. In other embodiments the energy-absorbing material is a liquid or a gel.

In another embodiment the interior hollow spherical structure is further lined or covered with a high-strength material such as KEVLAR® (Trademark of E. I. Du Pont De Nemours) or SPECTRA® (Trademark of Honeywell).

In yet another embodiment the bunker further comprises reactive armour disposed on the outside of the bunker.

In yet another embodiment the bunker further comprises an electromagnetic field.

In another aspect disclosed herein is a method of assembling a bunker comprising:

a) positioning a hollow spherical structure inside the cavity of a hollow sloped enclosing structure to form a space therebetween and b) filling the space with an energy-absorbing material.

In embodiments, the energy-absorbing material is a solid or a gel. The energy absorbing material is a compressible material.

In one embodiment of the method, the filling of the space with the energy-absorbing material is done by pouring the energy-absorbing material into the space.

In one embodiment of the method the sloped enclosing structure is comprised of steel. In one embodiment of the method the spherical structure is comprised of steel. In one embodiment of the method the energy-absorbing material is a compressible material. In one embodiment of the method the energy-absorbing material is selected from the group consisting of: concrete, a ballistic foam or sand.

DETAILED DESCRIPTION

Figure 1:
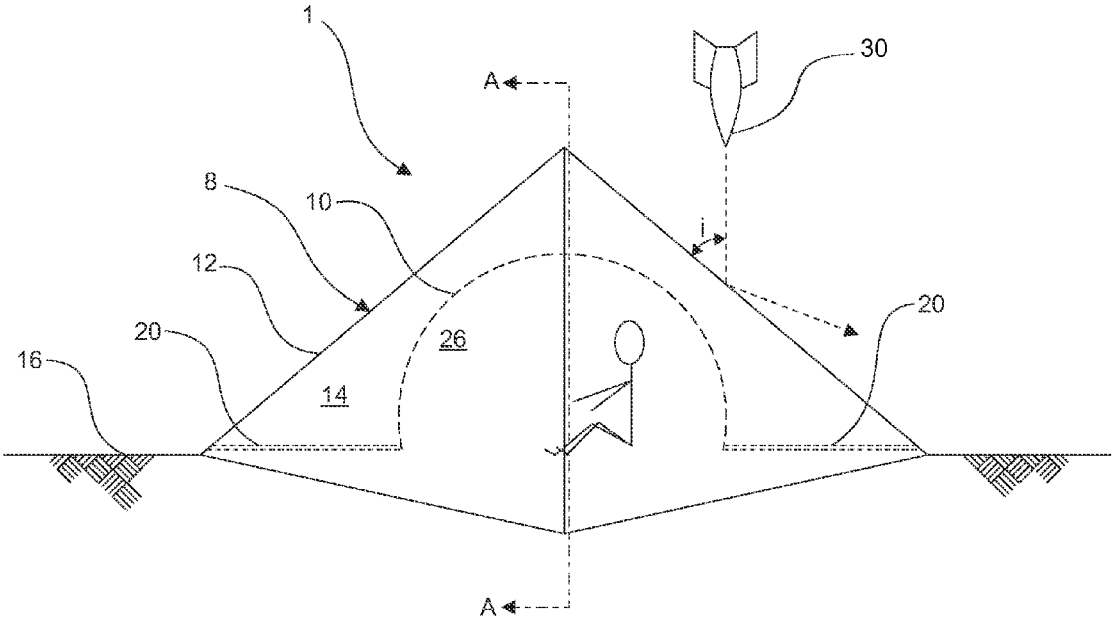
FIG. 1 is a perspective view of an embodiment of the bunker which has a four-sided right regular square pyramidal enclosing structure, inside of which is a hollow sphere. Disposed between these two components is an energy-absorbing material.
Figure 5:
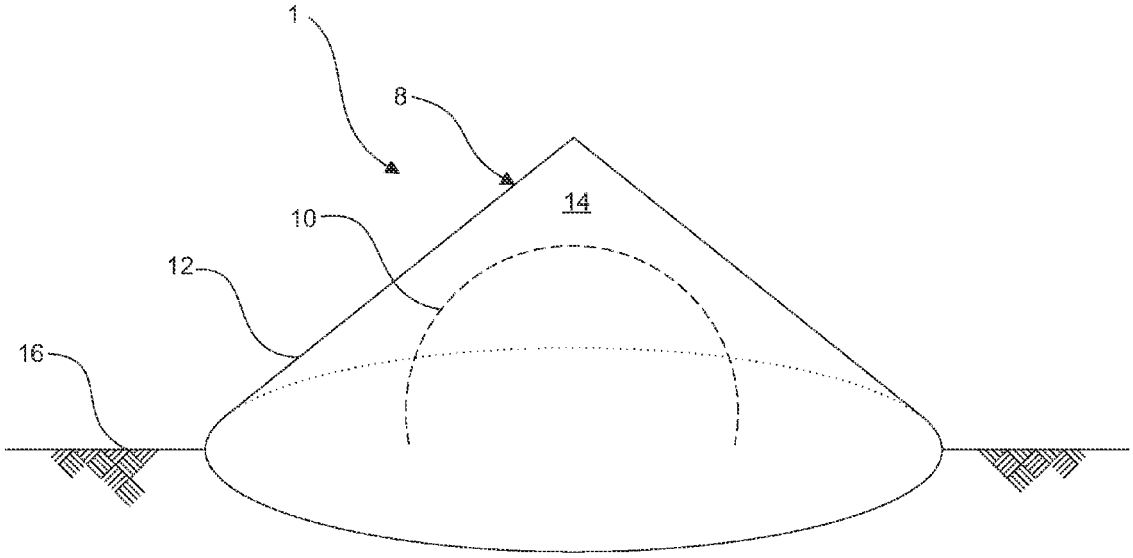
FIG. 5 is a perspective view of an embodiment of the bunker which has a cone shaped outer structure, inside of which is a hollow sphere. Disposed between these two components is an energy-absorbing material.

Described herein is a bunker 1 that comprises a hollow spherical structure 10 located inside a sloped enclosing structure 12. Disposed between the enclosing and spherical structures is an energy-absorbing material 14. As shown in FIGS. 1 and 5, the sloped enclosing structure is a hollow pyramid or cone.

More specifically, the bunker comprises three parts: a hollow sloped enclosing structure 12 having walls sloped from the vertical, a hollow spherical structure 10 inside the sloped enclosing structure and an energy-absorbing material 14 disposed between the sloped enclosing structure and the spherical structure. The sloped enclosing structure provides a sloped surface 8 that minimizes surfaces that are perpendicular to most incoming lateral and vertical loads.

In some embodiments of the bunker, the hollow sloped enclosing structure is not used, or it is used only for the purpose of fabricating the bunker (e.g., as a mold to enclose the energy-absorbing material until it hardens). In these embodiments, the exterior sloped surface 8 of the bunker is formed by the energy-absorbing material. Therefore, in this embodiment, the bunker 1 comprises an inner hollow spherical structure 10 located inside an outer sloped structure 9 that is made of an energy-absorbing material 14 and that forms sloped surface 8. See FIG. 6.

More specifically, in this embodiment the bunker comprises two parts: a sloped structure 9 made of an energy-absorbing material 14, and having a surface 8 sloped from the vertical, and a hollow spherical structure 10 disposed inside the sloped structure.

The bunker is of simple construction and therefore can be used as a portable bunker, for example in military settings where it is necessary to quickly set up a protective barrier for personnel or other materials. In one embodiment the bunker is set up inside a vehicle that is being used in military operations, for example, to transport personnel. It may also be set up and used as a permanent structure, for example in underground or above ground installations.

The combination of an outer pyramid or cone structure and an inner spherical structure is very stable and provides a high degree of protection for whatever or whoever is inside of the sphere. Combining these two structurally stable geometric shapes with a an energy-absorbing material that is capable of the absorbing energy from whatever load is applied to the outer pyramid or cone structure provides an even higher degree of protection for whatever or whoever is inside of the sphere. This combination provides a structure that is very resistant to physical compression.

Bunker 1 is a layered or composite structure that uses combinations of materials with different compressive and tensile strengths, and with different abilities to absorb and transmit energy, to effectively diffuse the energy released by incoming dynamic loads on the bunker.

The sloped structure 9 and sloped enclosing structure 12 include both pyramid and cone geometric shapes. A "pyramid" is a structure whose outer surfaces are triangular and converge to a single point at the top (vertex), the base of which can be trilateral, quadrilateral, or any polygon shape. In most cases, the walls of the structure are sloped from vertical, however one wall of a non-regular pyramid might be vertical and the others are necessarily sloped. All sides are tangent an inscribed sphere. Thus, a pyramid has at least three outer triangular surfaces (at least four faces including the base). A "cone", is a more general type of pyramid, in which the base is circular and the sides extend into a single vertex, commonly meeting above the centre of the circular base. Again, for a regular or near-regular cone, the sides are sloped from vertical. The sides of a pyramid are planar, whereas the sides of a cone are curved relative to an azimuthal reference. The square pyramid, with square base and four triangular outer surfaces, is a preferred embodiment of the pyramid of the bunker described herein. A right regular square pyramid is preferred. The triangular pyramid, with a triangular base and three triangular outer surfaces is another preferred embodiment. A right triangular pyramid is preferred. A pyramid or cone structure is very stable because it is very wide at the base and narrow at the top, and because it has sides that meet at a central point above the base.

It is well known that the effectiveness of a projectile hitting a structure is optimum when its angle of incidence, that is, the angle that a projectile path makes with a line that is perpendicular to the surface of the structure, is close to 0°; energy transfer being maximized. With larger angles of incidence, projectiles can be deflected, or ricochet off of the surface. When impacted by a projectile, the sloped surface 8 of a pyramid or cone present a surface that is inclined as compared to the path or vector of a projectile coming from the horizontal (side) or vertical (above), as compared to cuboid structures that have vertical and horizontal sides and tops. A cone has the additional advantage over a pyramid in that it does not comprise flat sides and thus minimizes the opportunity for a perpendicular strike.

By a "spherical structure" is meant a spherical or ovoid or ellipsoid structure, or other round three-dimensional structure, either complete (e.g., sphere) or partial (e.g., a dome). The spherical structure is sized to fit inside of the sloped enclosing structure. A "spherical" shape is very strong because applied force is distributed along the arc of the sphere instead of concentrating at any one point.

Reference will now be made to FIGS. 1 to 4, which show various embodiments of the bunker. The bunker disclosed herein is useful for protecting persons and property that are inside the inner spherical structure from the impact of projectiles such as bombs or shells, or that can otherwise withstand very high dynamic loads, such as cyclic, impactive or impulsive loads.

FIG. 1 shows a bunker 1 comprising an outer hollow pyramid structure 12, an inner hollow spherical structure 10, and disposed between these, an energy-absorbing material 14. The bunker is positioned on top of the ground surface 16. A projectile 30 is shown to be impacting the surface of the pyramid structure at an angle of incidence, i, that is greater than zero (i.e., the approach of the projectile is not perpendicular or normal to the surface of the bunker 1.) Because of this approach, the projectile is deflected by, ricochets off, or slides along the surface of the pyramid or cone, which reduces the effectiveness of the projectile, transferring less of the impactive energy.

The sloped enclosing structure 12 of the bunker disclosed herein can be comprised of a number of different materials, including metals and metal alloys, such as steel or aluminum, wood, or plastics. In some embodiments, the structure is intended to provide additional protection against outside loads applied to the bunker. In these embodiments, the material used to make the sloped enclosing structure will be strong material with high compressive and/or tensile strength, such as for example, steel. In other embodiments, the sloped enclosing structure is merely intended to function temporarily, as a form, for shaping the energy absorbing material into the shape of a cone or pyramid. In these embodiments the material used to make the sloped enclosing structure can be a relatively weak material with a low compressive and/or tensile strength, such as a plastic or cardboard material. Preferably the outer hollow sloped enclosing structure is made of one piece of material. However, it may be made of two or more pieces that connect together to form the structure. The sloped enclosing structure may be a completely enclosed on all sides (e.g., with a base and a door for access into and out of the bunker) or it may be a partial pyramid or cone as shown in the drawings herein (e.g., with no base or a partial base).

In the embodiment shown in FIG. 1, the hollow pyramid structure that comprises four sides and a square base, with the apex of the sides passing through the centre of the base (a square pyramid). Other preferred embodiments comprise three sides and a triangular base, with the apex of the sides passing through the centre of the base (triangular pyramid), or a cone as the sides and a circular base, with the apex of the sides passing through the centre of the base (right circular). These three embodiments can be easily and rapidly set up in a combat situation by one or a few individuals seeking to erect a protective structure.

The hollow sloped enclosing structure 12 may additionally be fabricated to include a reactive armour on the outside, which is an armour that reacts in some way to the impact of a projectile, such as an explosive reactive armour (ERA), self-limiting explosive reactive armour (SLERA), non-energetic reactive armour (NERA), non-explosive reactive armour (NxRA), and electric reactive armour. This armour would function to reduce the damage done to the bunker when a projectile impacts the bunker.

Further, or in addition, the bunker may additionally be provided with an electric current that generates an electromagnetic field, for example by running a conductive circuit via copper wire through the energy-absorbing material. The electromagnetic current will detonate the piezoelectric fuse on an incoming projectile (e.g., a rocket propelled grenade, or RPG) before it contacts the sloped enclosing structure. The power source for the electromagnetic field can be the battery from the vehicle in which the bunker is being transported, or an independent battery or other power source. In this embodiment, the energy in the RPG is substantially weakened before it first contacts the bunker, and in the case of an incoming RPG, the field will detonate the piezoelectric fuse on the incoming RPG before it contacts the bunker resulting in a concussive, yet dispersed transfer of energy through the air.

The inner hollow spherical structure 10 is comprised of a strong material such as metals (e.g., steel) or strong polymers. In a preferred embodiment the inner hollow sphere is comprised of a material that has a higher tensile strength than the energy-absorbing material 14.

The sphere is hollow, including an inner cavity 26 to hold persons or property. The purpose of the inner hollow spherical structure is to distribute any residual energy about the inner cavity 26 and retain its structural integrity and thus that of the elements housed within. The spherical structure absorbs and/or distributes energy from the energy-absorbing material that reaches it. To this end, the inner spherical structure is designed to withstand and absorb the loads applied to it from the energy-absorbing material. When a projectile hits the outer pyramid or cone structure, energy may be transferred to the energy-absorbing material, which absorbs some or all of that energy by any number of means, including by compression, compaction or crushing. Any remaining energy transferred from the energy-absorbing material to the sphere is distributed around the periphery of the sphere, as shown by the arrows 32 in FIG. 2. In some embodiments the inner hollow spherical structure may also function to present a final barrier to the projectile, should it be able to pass through to this layer of the bunker.

Preferably the inner hollow spherical structure is made of one piece of material. However, it may be made of two or more pieces that connect together to form the structure. In addition, the hollow spherical structure may be lined or coated with a high-strength material such as KEVLAR®, SPECTRA® or other material that would function to prevent spalling and injury to those inside the spherical structure if the bunker were to be penetrated by a projectile. The sphere may be a complete sphere (with a door for access into and out of the sphere) or a partial sphere as shown in the drawings herein.

Filling the space between the outer sloped enclosing structure and the inner spherical structure, or forming the sloped structure 9, is an energy-absorbing material. Energy-absorbing materials typically comprise materials that compress in response to an applied load. "Compressible" refers to the ability of a material to be reduced in volume in response to the application of an inward force on the material. In the instant application, a compressible material is any material that is compressible under the forces that would be applied to it from the impact of a projectile or other dynamic load on the bunker, and that as a result of this compression absorbs a significant amount of the energy applied to it. A compressible material in this context includes a material that is resiliently compressible (e.g., an elastomeric foam), compactable (e.g., sand) and crushable (e.g., concrete).

Examples of suitable compressible materials useful in herein are: concrete, a ballistic foam, a polymer foam, a metal foam (e.g., aluminum foam), sand, rocks or boulders, plastics, spheres (e.g., marbles, hollow spheres), KEVLAR® or SPECTRA® strands. Preferably the compressible material is in full contact with both the inner surface of the outer pyramid or cone (when used), and with the outer surface of the inner spherical structure. "Concrete" as used herein means an aggregation of minerals, such as sand, that has been coalesced into a solid mass with cement and water. In a combat situation, where it is desired to rapidly set up the bunker, a ballistic foam is preferred, as it can be injected between the hollow spherical structure 10 and the hollow pyramid or cone 12, when they are assembled together. In this embodiment, it may be desirable to include spacers 20 between the bottom edges of the inner sphere 10 and outer pyramid/cone 12, to assist in centering the sphere inside the pyramid/cone, and ports 22, for injecting the foam into the space between the sphere and the pyramid or cone.

The energy-absorbing material functions to reduce the forces applied to the inner spherical structure 10, by absorbing a significant amount of the energy that is released when a projectile or other dynamic load impacts the bunker. The energy-absorbing material 14 is, therefore, a material that has the capacity to absorb a substantial amount of the energy released when the projectile or other dynamic load impacts the bunker, to thereby help to preserve the structural integrity of the inner spherical structure. In some embodiments, the energy-absorbing material is an energy-absorbing gel or plastic.

In embodiments that do not comprise the outer sloped enclosing structure 12, the energy-absorbing material also provides the sloped surface 8 that functions to cause projectiles to deflect or ricochet off of the surface and the bunker. As is apparent, in these embodiments the energy-absorbing material is a solid.

In a preferred embodiment the energy-absorbing material is concrete and the inner spherical structure, or both of the outer pyramid or cone structure and the inner spherical structure, are made of steel.

Figure 2:
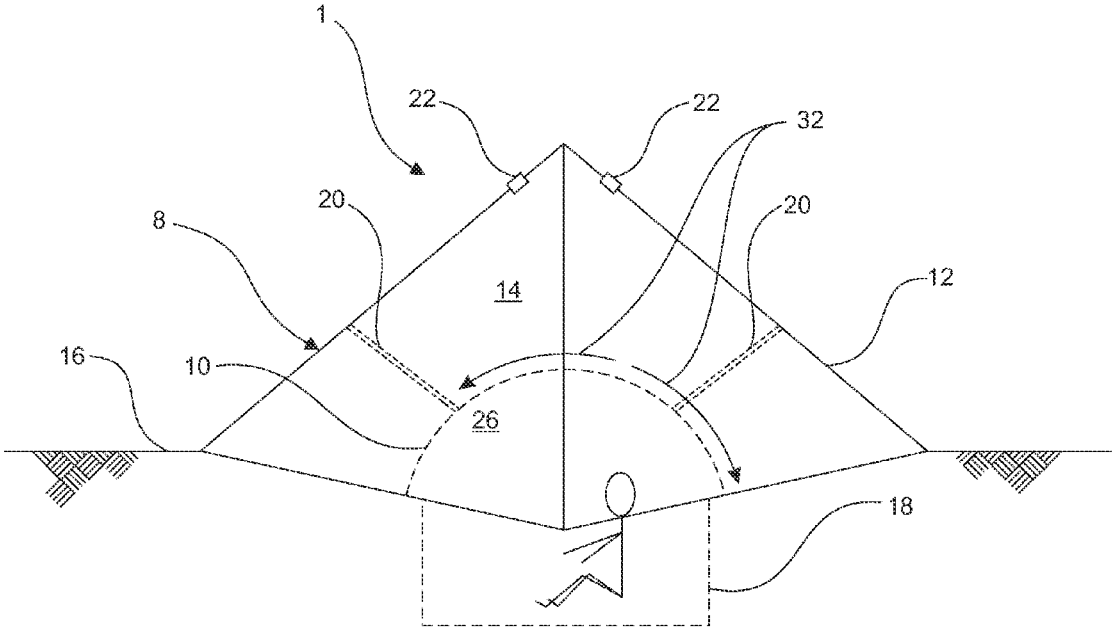
FIG. 2 is a perspective view of an embodiment of the bunker which has a right regular square four-sided pyramidal enclosing structure, inside of which is a hollow sphere, and disposed between these two, an energy-absorbing material. In this embodiment, the sphere is displaced downwards relative to the pyramid, as compared to the bunker that is shown in FIG. 1, and is therefore more in the shape of a dome.

FIG. 2 shows an alternative embodiment of the bunker 1 described herein. In this embodiment the layer of energy-absorbing material 14 is thicker as compared to that shown in the embodiment of FIG. 1. To compensate for the smaller sphere, a trench 18 is dug into the ground underneath the sphere, below the ground surface 16. This trench can be sized to fit persons or materials, such as ammunition. The thickness of the layer of the energy-absorbing material 14 will vary, depending upon the other features of the bunker. For example, if thicker layers 10 and 12 are used, the layer of energy-absorbing material may be thinner than in a bunker of the same dimensions but with thinner layers 10 and 12.

Figure 3:
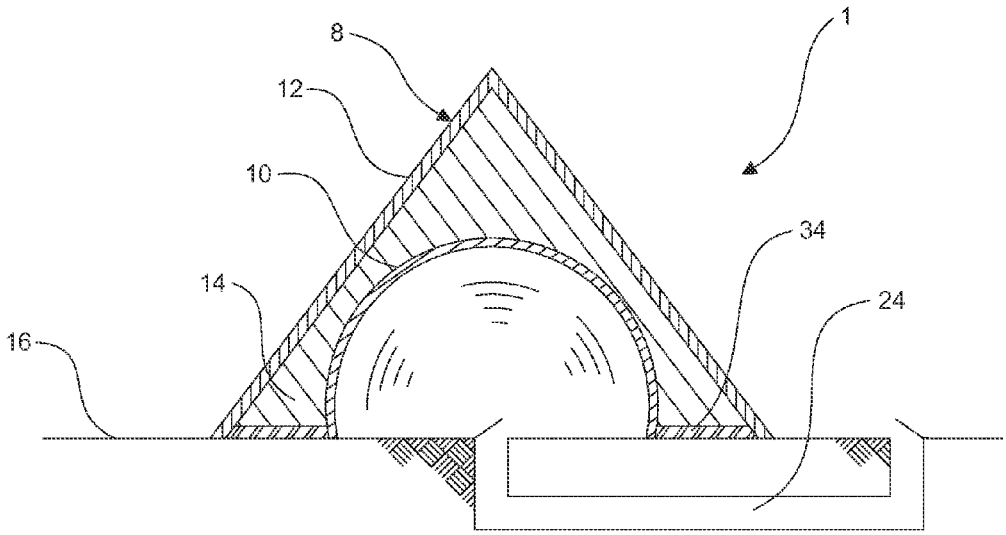
FIG. 3 is a cross section of the embodiment shown in FIG. 1, taken along line A-A of FIG. 1.

FIG. 3 shows a cross-section of the bunker 1, taken along line A-A of FIG. 1 to show the layers corresponding to the exterior sloped enclosing structure 12, the spherical structure 10 and the energy-absorbing material 14. FIG. 3 also shows an embodiment of the bunker in which access to the bunker is gained by an underground tunnel 24. The tunnel may comprise openings that are controlled and reinforced, to avoid entry into the bunker by unwanted persons.

Figure 4:
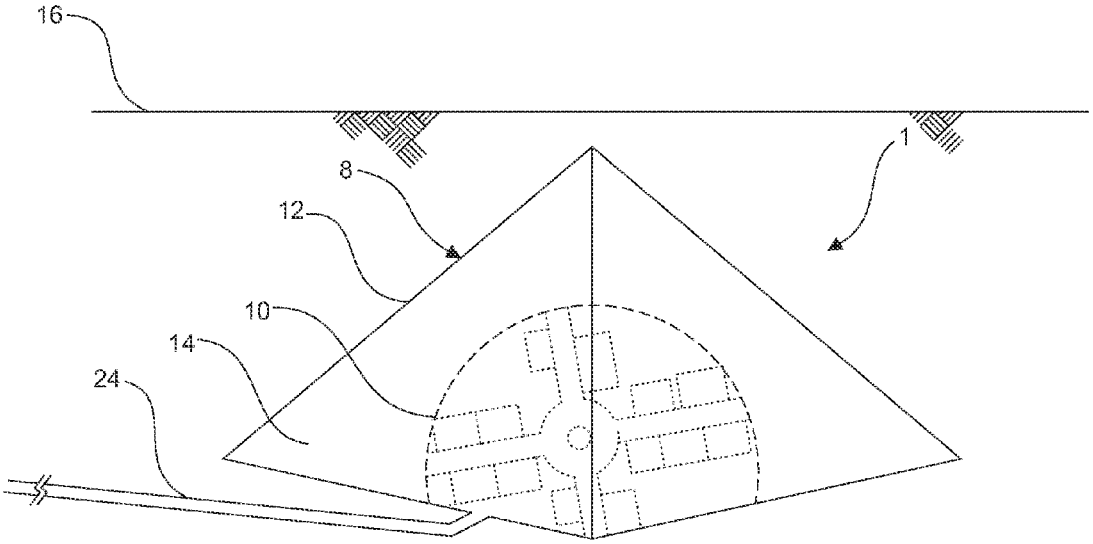
FIG. 4 is a perspective view of an embodiment of the bunker which has been installed underground, and which houses a building inside of the hollow sphere.

FIG. 4 shows an embodiment of the bunker 1 which has been installed under the surface of the ground, and which is very large, housing a building or complex inside the hollow sphere shaped structure 10, in cavity 26. Access to the inside of the sphere is achieved via an underground tunnel 24 that may comprise openings that are controlled and reinforced, to avoid entry into the bunker by unwanted persons. Alternatively, a door or doors (not shown) may be provided to allow access into cavity 26 from the outside of the bunker. The bunker may also be ventilated.

FIG. 5 shows an embodiment of the bunker which has a cone shaped outer enclosing structure 12, inside of which is a hollow sphere 10. Disposed between these two components is the energy-absorbing material 14.

Figure 6:
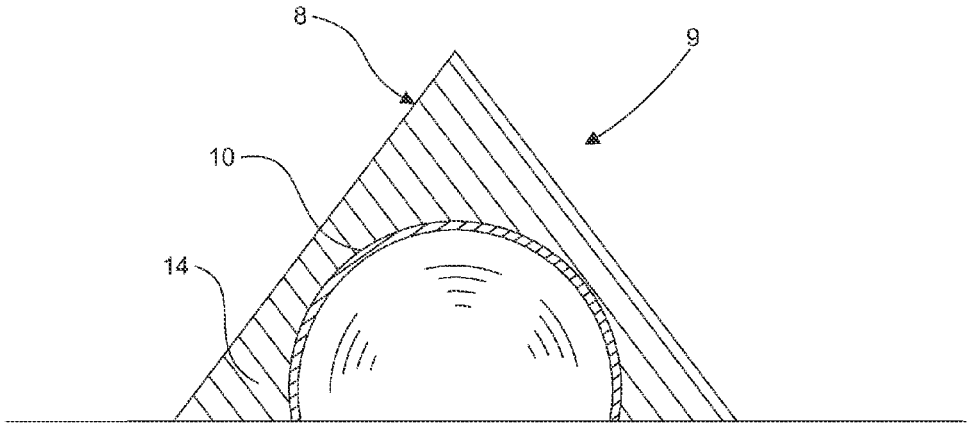
FIG. 6 is a cross section of an embodiment of the bunker that does not have a sloped enclosing structure.

FIG. 6 is a cross section of an embodiment of the bunker that does not have an outer sloped enclosing structure surrounding the energy-absorbing material 14. Therefore, the sloped surface 8 is formed by the energy-absorbing material 14. The hollow sphere shaped structure 10 is disposed inside the energy-absorbing material 14 which forms an exterior sloped structure 9 that can have a pyramidal or cone shape.

In some embodiments the energy-absorbing material is confined between the sloped enclosing structure 12 and the sphere 10. Depending on the purpose for which the bunker is to be used, and in particular, depending upon whether it is intended to be used as permanent or temporary construct, the space between the structure 12 and the sphere 10 may or may not be enclosed by a base structure 34 (see FIG. 3). For example, in the situation where the bunker is to serve as a temporary construct rapidly erected, the energy-absorbing material may be confined only by the structure 12, the sphere 10 and the ground (i.e., no base structure is used and the ground serves to confine the compressible material). Alternatively, base structure 34 may be a flexible plastic, whose function is to aid in properly spacing the structure 12 and the sphere 10 relative to one another, and to confine/enclose the energy absorbing material. If the bunker is to serve as a permanent construct, base structure 34 may, for example, be comprised of steel.

As is apparent from the above description, the force from the impact of a dynamic load is resisted by the bunker described herein by one or more of the following mechanisms, depending on the magnitude of the force and the area of its application:

a) a projectile may be deflected and/or slide along the sloped surface of the bunker, thereby lessening the impact of the projectile;
b) an exterior sloped enclosing structure may absorb and diffuse some of the energy from the load,
c) the exterior sloped enclosing structure may be made of a material that resists penetration of the projectile;
d) at a small level of loading, the impact of the projectile may result in a localized compression, compaction or crushing of the energy-absorbing layer at the area of impact;
e) at a higher level of loading the impact of the projectile may result in a larger area of compression, compaction or crushing of the energy absorbing layer until the total energy of the load is absorbed;
f) if the total energy of the load is not absorbed by the energy-absorbing layer, the inner spherical structure absorbs and diffuses any remaining energy from the load, and
g) the inner spherical structure may be made of a material that resists penetration of the projectile.

The bunker may be made by positioning a hollow spherical structure 10 inside the cavity of a hollow sloped enclosing structure 12 and then filling the space between structures 10 and 12 with the energy-absorbing material 14. The energy-absorbing material can be poured into the space (e.g., sand or cement) or it can be injected into the space (e.g., as a foam). A base structure 34 may serve to further confine the energy-absorbing material in the space between structures 10 and 12.

While the bunker has been described in conjunction with the disclosed embodiments, it will be understood that the bunker is not intended to be limited to these embodiments. On the contrary, the bunker is intended to cover alternatives, modifications, and equivalents, which may be included within the spirit and scope of the bunker as described herein.

The invention claimed is:

1. A bunker comprising
a) an exterior pyramid or cone structure made from an energy-absorbing material, and
b) a hollow spherical structure inside the exterior pyramid or cone structure.

2. The bunker of claim 1 further comprising a pyramid-shaped enclosing structure disposed about the exterior pyramid structure or a cone-shaped enclosing structure disposed about the exterior cone structure.

3. The bunker of claim 2 wherein the enclosing structure is comprised of steel.

4. The bunker of claim 3 wherein the spherical structure is comprised of steel.

5. The bunker of claim 1, wherein the energy-absorbing material is a compressible material.

6. The bunker of claim 5, wherein the compressible material is concrete or ballistic foam.

7. The bunker of claim 2 wherein the energy-absorbing material is a liquid or gel.

8. A bunker comprising:
a) an exterior pyramid- or cone-shaped enclosing structure,
b) an interior hollow spherical structure inside the exterior pyramid or cone enclosing structure,
c) a space between the exterior pyramid or cone enclosing structure and the interior hollow spherical structure
d) an energy-absorbing material disposed in the space.

9. The bunker of claim 8, wherein the exterior enclosing structure is comprised of steel.

10. The bunker of claim 8, wherein the spherical structure is comprised of steel.

11. The bunker of claim 8, wherein the energy-absorbing material is a compressible material.

12. The bunker of claim 11, wherein the compressible material is selected from the group consisting of: concrete, ballistic foam and sand.

13. The bunker of claim 8, wherein the energy-absorbing material is a liquid or gel.

14. A method of assembling a bunker comprising:
a) positioning a hollow spherical structure inside a hollow pyramid or cone enclosing structure to form a space therebetween and
b) filling the space with an energy-absorbing material.

15. The method of claim 14, wherein the filling of the space with the energy absorbing material is done by pouring or injecting the energy-absorbing material into the space.

16. The method of claim 14, wherein the energy-absorbing material is a compressible material.

17. The bunker of claim 2, wherein the energy-absorbing material is a compressible material.

18. The bunker of claim 3, wherein the energy-absorbing material is a compressible material.

19. The bunker of claim 4, wherein the energy-absorbing material is a compressible material.

20. The bunker of claim 17, wherein the compressible material is concrete or ballistic foam.

* * * * *